US008025616B1

(12) United States Patent
Hsu et al.

(10) Patent No.: US 8,025,616 B1
(45) Date of Patent: Sep. 27, 2011

(54) VERTICAL TWIST FIGURE SHAPING MACHINE

(75) Inventors: Chan Chun Hsu, Taichung (TW); Yung Shian Liu, Taichung (TW)

(73) Assignee: Hito Health Tech Co., Ltd., Taichung (TW)

( * ) Notice: Subject to any disclaimer, the term of this patent is extended or adjusted under 35 U.S.C. 154(b) by 0 days.

(21) Appl. No.: 12/772,229

(22) Filed: May 2, 2010

(51) Int. Cl.
*A63B 22/14* (2006.01)

(52) U.S. Cl. ..... 482/147; 482/146

(58) Field of Classification Search ..... 482/62, 482/66–69, 130, 140, 146, 147, 95, 96, 131
See application file for complete search history.

(56) References Cited

U.S. PATENT DOCUMENTS 3,784,193 A * 1/1974 Simjian ..... 482/147
5,632,711 A * 5/1997 Hwang ..... 482/147
6,022,303 A * 2/2000 Abdo ..... 482/140
6,726,608 B1 * 4/2004 Hsu ..... 482/130
7,223,218 B2 * 5/2007 Karafa ..... 482/126
7,335,134 B1 * 2/2008 LaVelle ..... 482/1
7,708,675 B2 * 5/2010 Miskech ..... 482/142
2006/0293153 A1 * 12/2006 Porth et al. ..... 482/52
2009/0209397 A1 * 8/2009 Miskech ..... 482/140

* cited by examiner

*Primary Examiner* — Allana Lewin

(57) ABSTRACT

A vertical twist figure shaping machine includes a base, a supporting unit, a tread, a U-shaped element and two handle units. The supporting unit is pivotally supported on the base. The tread is supported on the base. The U-shaped element includes a middle section connected to the supporting unit and two lateral sections extending from the middle section. Each of the handle units includes a bar, a primary handle and an auxiliary handle. The bar is pivotally connected to a related one of the lateral sections of the U-shaped element. The primary handle includes front and rear sections both extending from the bar with an obtuse angle defined between them. The auxiliary handle is transversely connected to the bar in front of the primary handle.

8 Claims, 7 Drawing Sheets

VERTICAL TWIST FIGURE SHAPING MACHINE

BACKGROUND OF INVENTION

1. Field of Invention

The present invention relates to a vertical twist figure shaping machine and, more particularly, to a vertical twist figure shaping machine with which a user can exercise different muscles by griping different portions thereof while spinning the body.

2. Related Prior Art

It has been proven that a person can enhance the muscles and sinews connected to the spine by spinning the body about a vertical axis. Thus, the person's can support the spine well and prevent or reduce pain in the neck, the back and the hips.

There is a first conventional vertical twist figure shaping machine in the form of a chair. The first conventional vertical twist figure shaping machine includes a lower post, a seat supported on the lower post, an upper post, a backrest connected to the upper post, and a rotating unit for automatically rotating the upper post and therefore the backrest relative to the seat. The axis of the upper post can never be coaxial with the axis of a user's spine no matter how close. The user is forced to spin his or her body about the spine while pivoting the spine about a horizontal axis. Hence, the first conventional vertical twist figure shaping machine cannot make the user spin his or her body about a vertical axis.

There is a second conventional vertical twist figure shaping machine in the form of a chair. The second vertical twist figure shaping machine includes a tube, a lower post rotationally inserted in the tube, a seat supported on the lower post, a platform supported on the tube, an upper post rotationally supported on the platform, a backrest connected to the upper post, and a connecting unit for connecting the upper post to the lower post. Thus, the back rest can rotate opposite to the seat. Again, the axis of the upper post can never be coaxial with the axis of a user's spine no matter how close. The user is forced to spin his or her body about the spine while pivoting the spine about a horizontal axis. Hence, the second conventional vertical twist figure shaping machine cannot make the user spin his or her body about a vertical axis.

The present invention is therefore intended to obviate or at least alleviate the problems encountered in prior art.

SUMMARY OF INVENTION

It is the primary objective of the present invention to provide a vertical twist figure shaping machine with which a user can exercise different muscles by gripping different portions thereof while spinning the body.

To achieve the foregoing objective, the vertical twist figure shaping machine includes a base, a supporting unit, a tread, a U-shaped element and two handle units. The supporting unit is pivotally supported on the base. The tread is supported on the base. The U-shaped element includes a middle section connected to the supporting unit and two lateral sections extending from the middle section. Each of the handle units includes a bar, a primary handle and an auxiliary handle. The bar is pivotally connected to a related one of the lateral sections of the U-shaped element. The primary handle includes front and rear sections both extending from the bar with an obtuse angle defined between them. The auxiliary handle is transversely connected to the bar in front of the primary handle.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
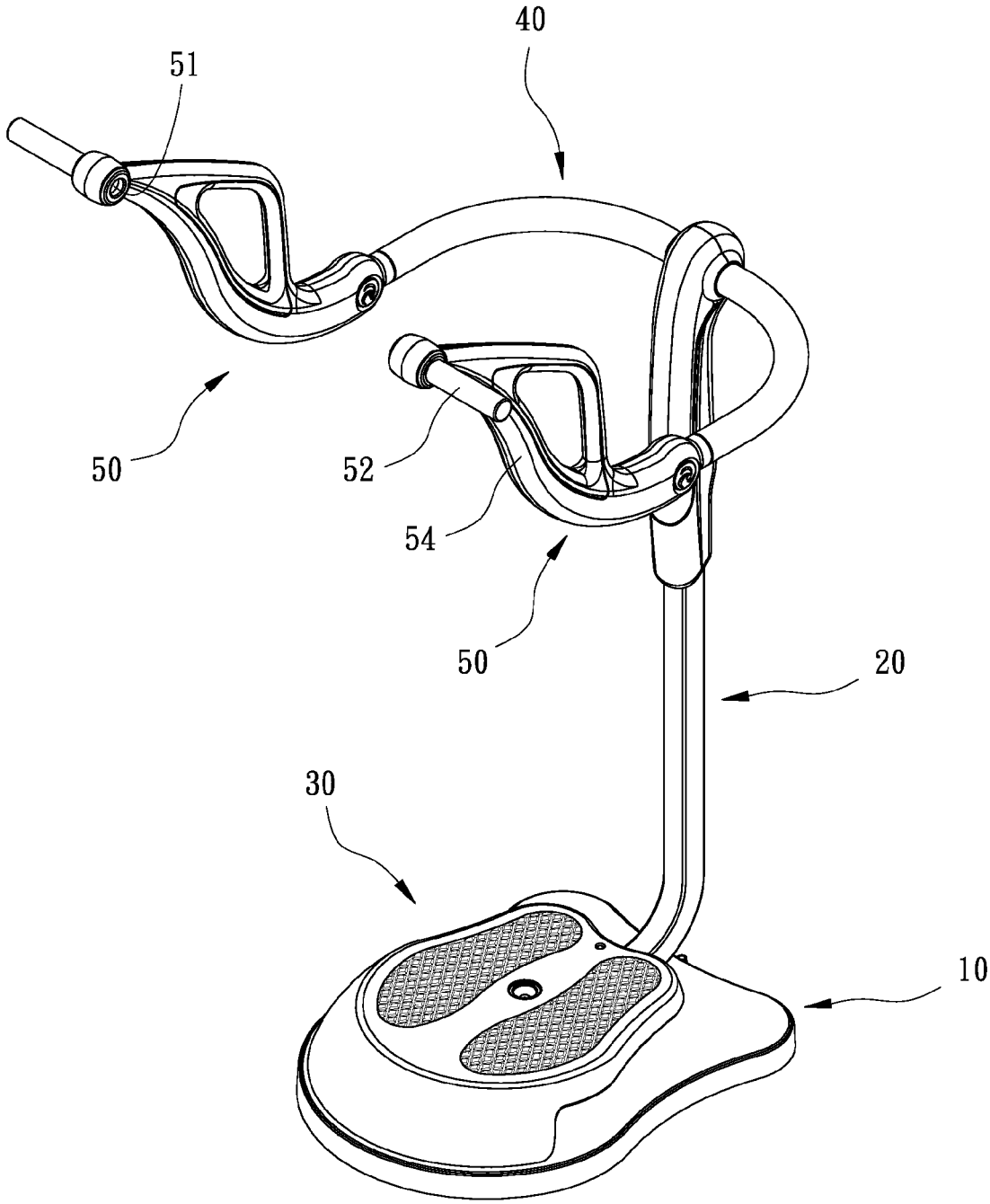
FIG. 1 is a perspective view of a vertical twist figure shaping machine according to the preferred embodiment of the present invention.
Figure 2:
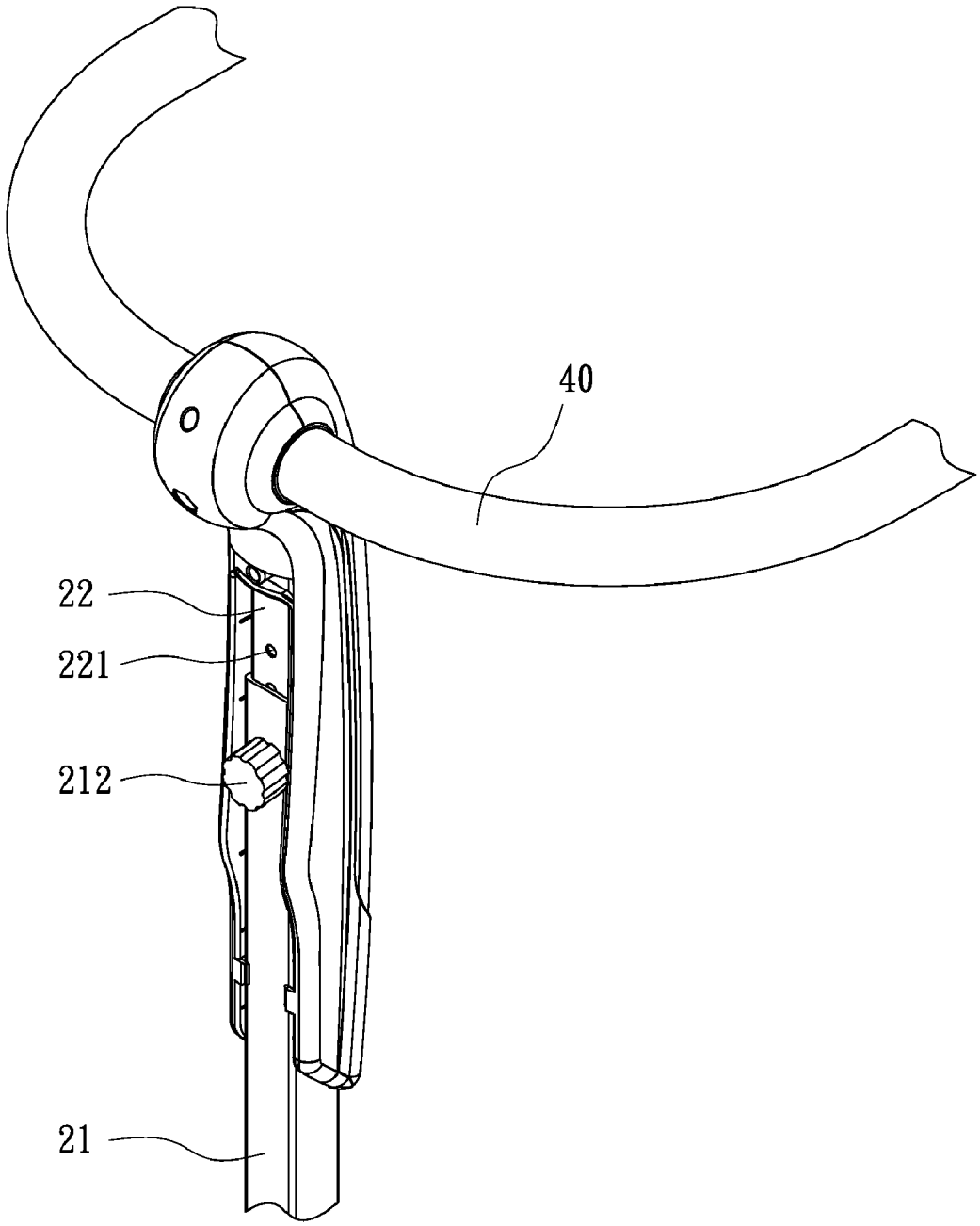
FIG. 2 is an enlarged partial view of the vertical twist figure shaping machine shown in FIG. 1.
Figure 3:
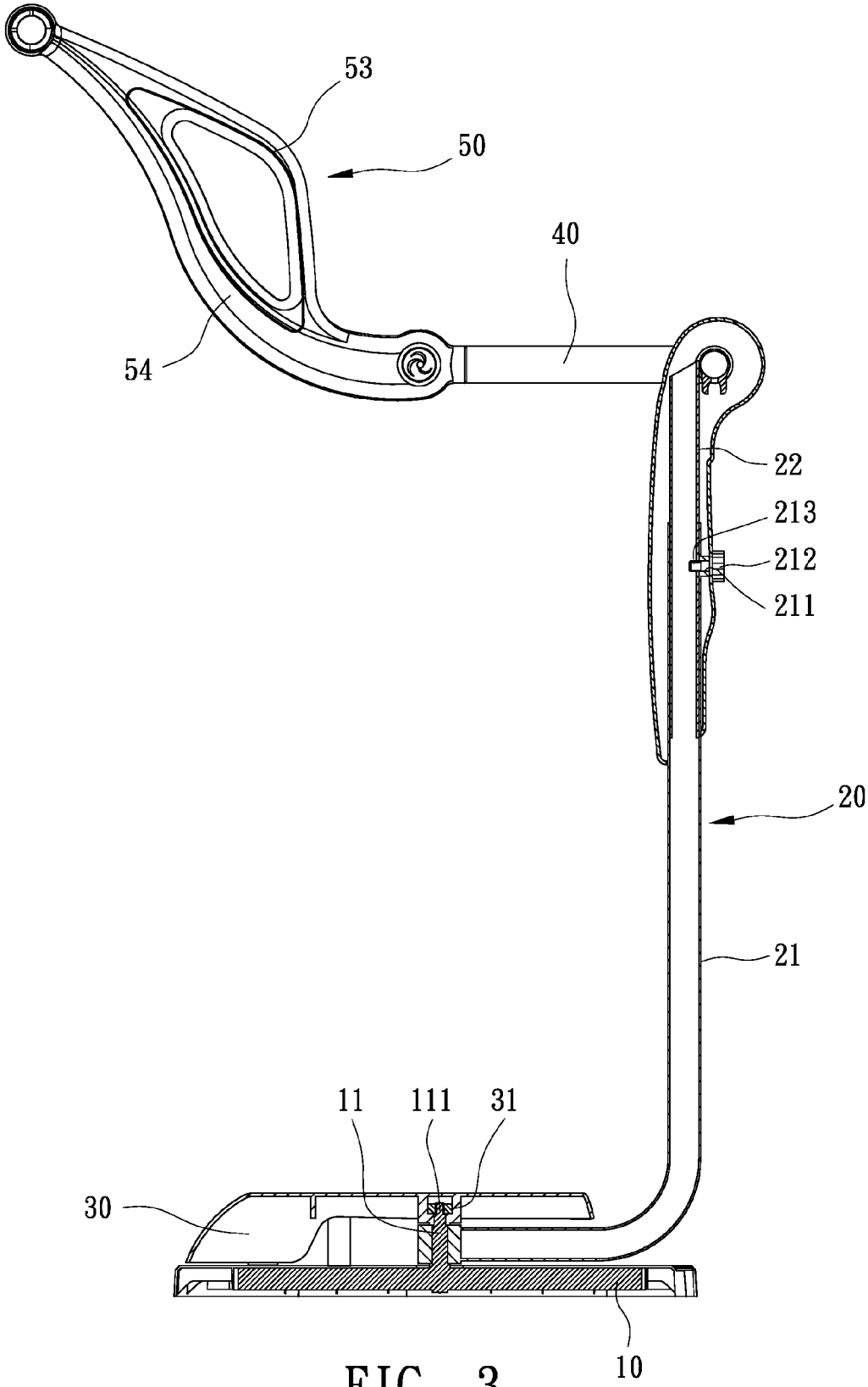
FIG. 3 is a cross-sectional view of the shown in FIG. 1.

Referring to FIGS. 1 through 3, a vertical twist figure shaping machine includes a base 10, a supporting unit 20, a tread 30, a U-shaped element 40, and two handle units 50 according to the preferred embodiment of the present invention. The base 10 includes a stem or axle 11 extending vertically from an upper face thereof. The axle 11 is formed with a thread 111 near a free end thereof.

The supporting unit 20 includes an L-shaped external tube 21 and an internal tube 22. A horizontal section of the L-shaped external tube 21 is pivotally connected to the base 10. In particular, the axle 11 is inserted through an aperture defined in a ring formed at a free end of the horizontal section of the L-shaped external tube 21. The vertical section of the L-shaped external tube 21 includes a screw hole 211 defined therein near a free end thereof. At least a section of the internal tube 22 is telescopically inserted in the vertical section of the L-shaped external tube 21. The internal tube 22 includes a series of apertures 221 defined therein along an axis thereof. A knob 212 is attached to an end of a screw 213. By operating the knob 212, the screw 213 is inserted in a selected one of the apertures 221 through the screw hole 211. Thus, the internal tube 22 is retained in a desired position relative to the L-shaped external tube 21.

The tread 30 is supported on the base 10 and over the horizontal section of the L-shaped external tube 21. The axle 11 is inserted through an aperture defined in the tread 30. A nut 31 is engaged with the thread 111. Thus, the tread 30 is retained on the base 10.

The U-shaped element 40 includes a middle section extending between lateral sections. The middle section of the U-shaped element 40 is pivotally connected to the free end of the internal tube 22. Thus, the lateral sections of the U-shaped element 40 can be tilted.

Each of the handle units 50 includes a bar 54, a primary handle 53 and an auxiliary handle 52. The bar 54 is connected to a related one of the lateral sections of the U-shaped element 40. The bar 54 extends upwards and forwards from the related lateral section of the U-shaped element 40, with an angle of about 135 degrees defined between them. The primary handle 53 includes front and rear sections both extending from the bar 54, with a space defined between the primary handle 53 and the bar 54. The primary handle 53 is made in a bent configuration. That is, there is an obtuse angle between the front and rear sections of the primary handle 53. The auxiliary handle 52 is formed with a thread engaged with a screw hole 51 defined in a free end of the bar 54.

The auxiliary handles 52 can be located between the lateral sections of the U-shaped element 40 if a user has short arms. The auxiliary handles 52 can be located outside the lateral sections of the U-shaped element 40 if the user has long arms.

Figure 4:
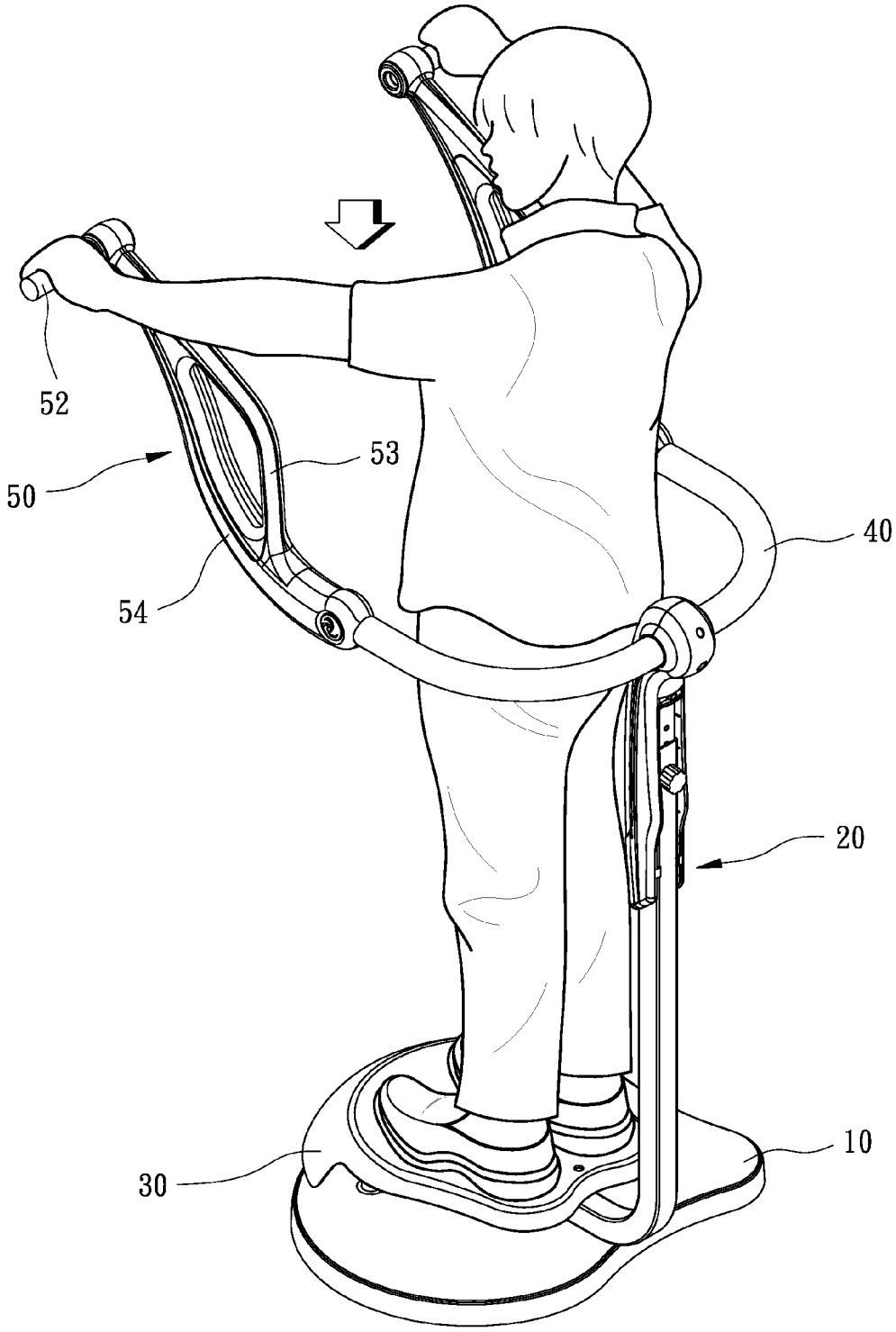
FIG. 4 is a perspective view of a user gripping two auxiliary handles of the vertical twist figure shaping machine shown in FIG. 1.

Referring to FIG. 4, the user grips the auxiliary handles 52 while standing on the tread 30. The user completely stretches his arms. The user can exercise by twisting, i.e., pivoting his body relative to his hips. Thus, the user can exercise and enhance the biceps of his arms, including the muscles and the sinews. Moreover, the user can extend the muscles in his face through the muscles in his neck. Thus, the user can make the profile of his face smooth and beautiful.

Figure 5:
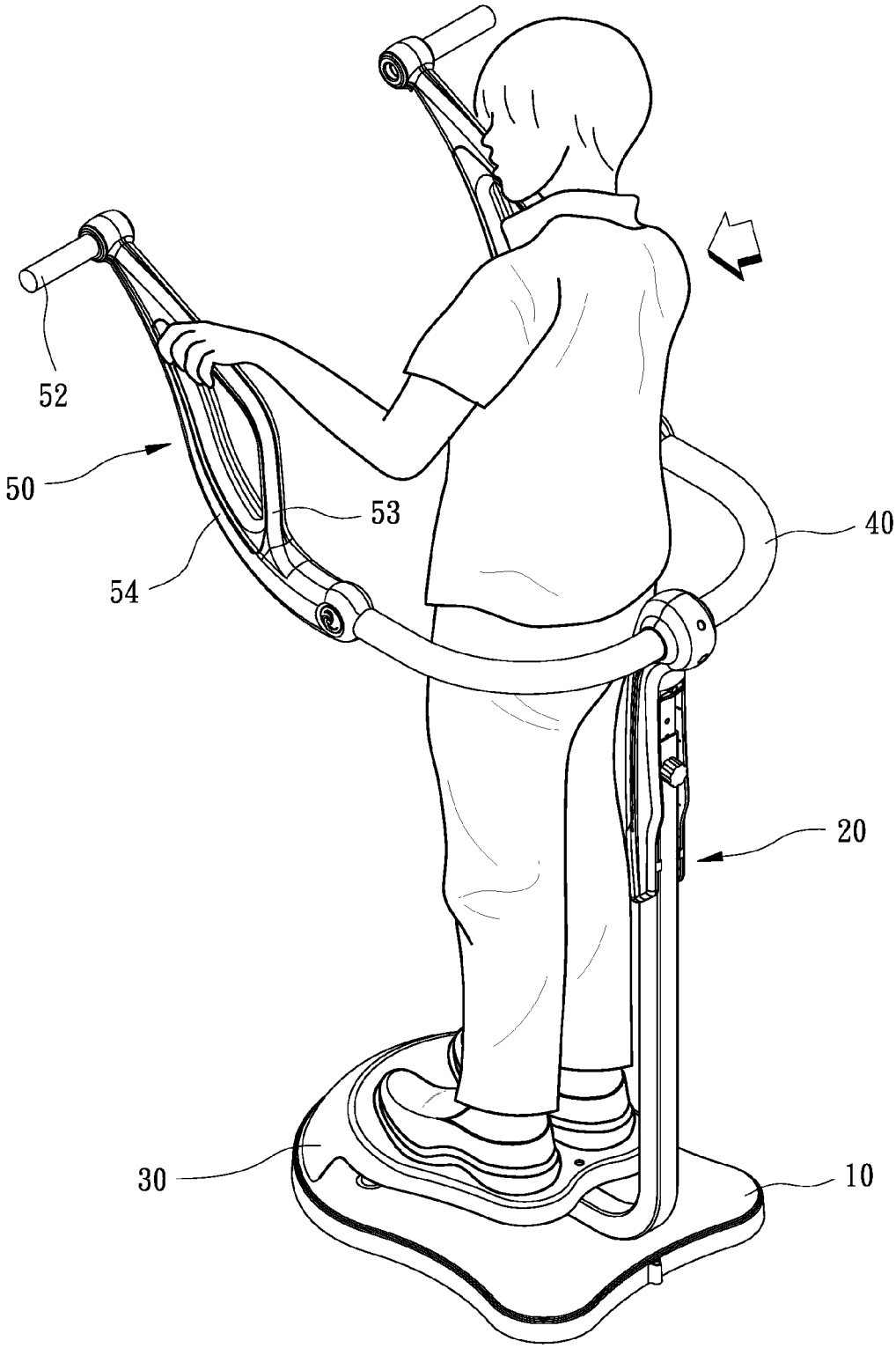
FIG. 5 is a perspective view of the user gripping a front section of each primary handle of the vertical twist figure shaping machine shown in FIG. 1.

Referring to FIG. 5, the user grips the front section of each of the primary handles 53 while standing on the tread 30. The user slightly bends his arms. The user can exercise by twisting, i.e., pivoting his body relative to his hips. Thus, the user can exercise and enhance the triceps of his arms, including the muscles and the sinews, as indicated with an arrow head. Moreover, the user can extend the muscles in his back. Thus, the user can shape the profile of his back.

Figure 6:
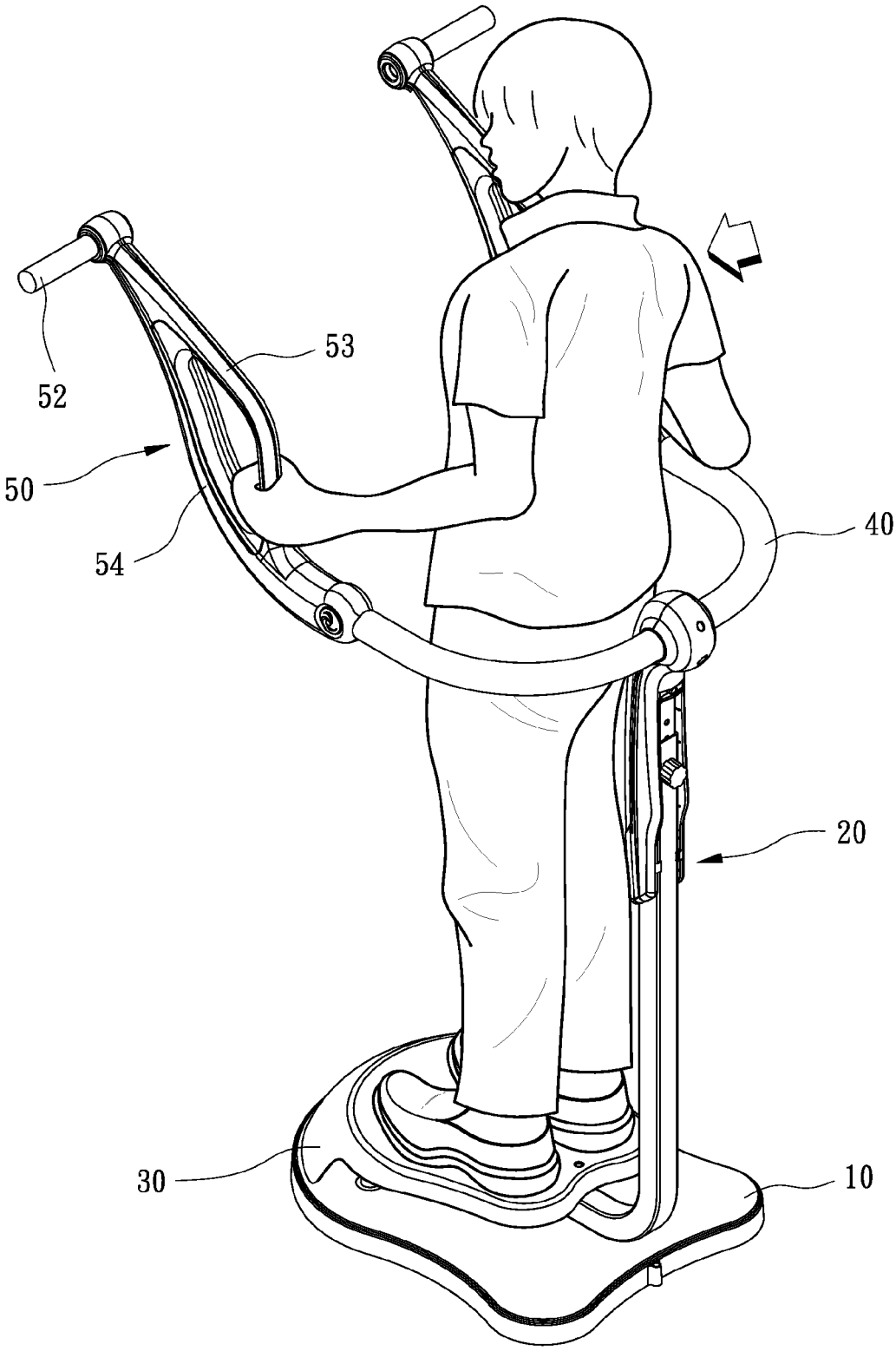
FIG. 6 is a perspective view of the user gripping a rear section of each primary handle of the vertical twist figure shaping machine shown in FIG. 1.

Referring to FIG. 6, the user grips the rear section of each of the primary handles 53 while standing on the tread 30. The user further bends his arms. The user can exercise by twisting, i.e., pivoting his body relative to his hips. Thus, the user can exercise and enhance the triceps of his arms, including the muscles and the sinews, as indicated with an arrow head. Moreover, the user can extend his abdominal muscles. Thus, the user can shape the profile of his belly.

Figure 7:
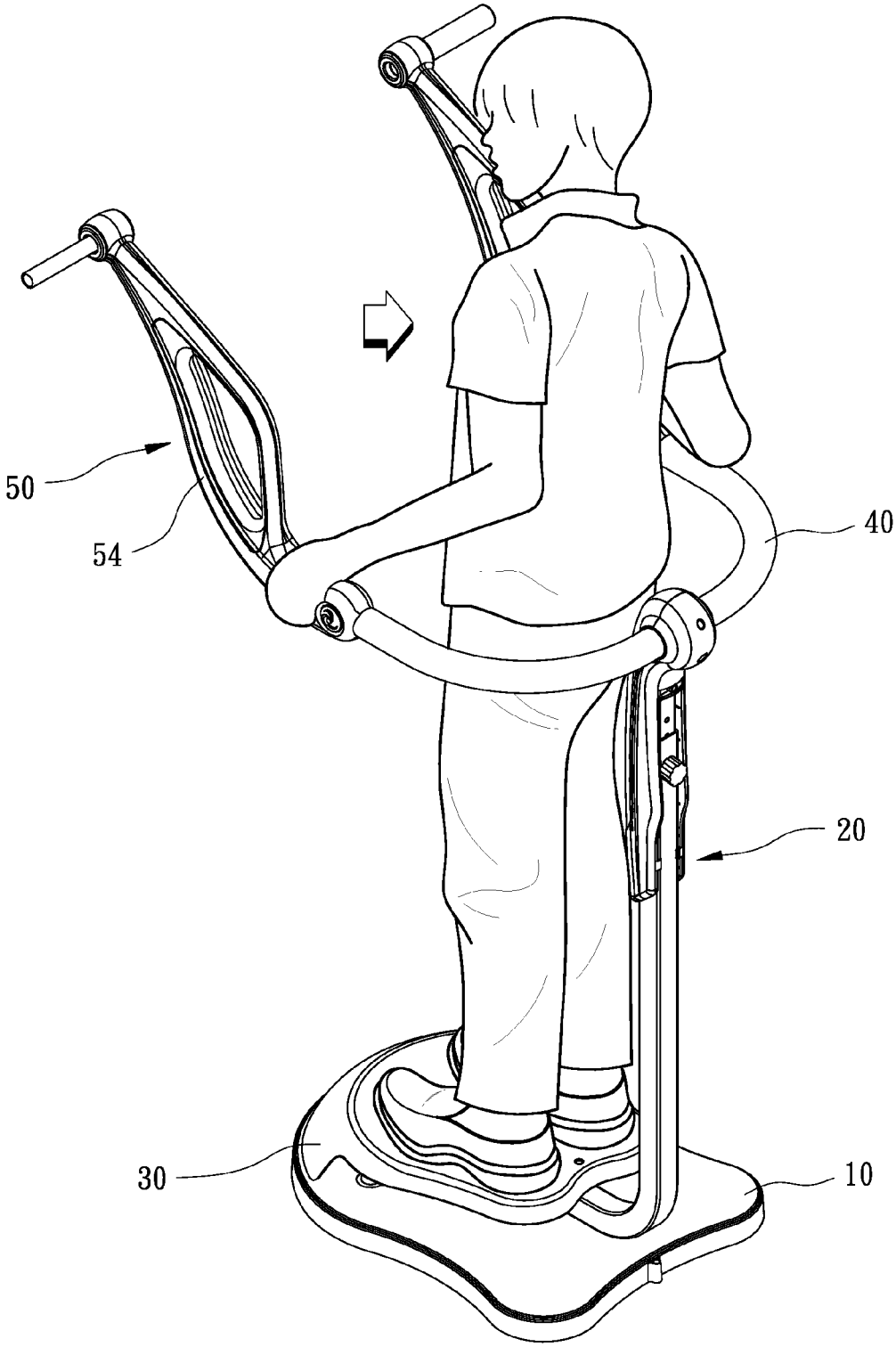
FIG. 7 is a perspective view of the user gripping two bars of the vertical twist figure shaping machine shown in FIG. 1.

Referring to FIG. 7, the user grips the bars 54 opposite to the auxiliary handles 52 while standing on the tread 30. The user locates his upper arms besides his body. The user can exercise by twisting, i.e., pivoting his body relative to his hips. Thus, the user can exercise and enhance his pectorals, including the muscles and the sinews, as indicated with an arrow head. Moreover, the user can adjust his spine. Thus, the user can reach a perfect body shape.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A vertical twist figure shaping machine including:

a base (10);

a supporting unit (20) pivotally supported on the base (10), the supporting unit (20) including an L-shaped external tube (21) formed with a horizontal section pivotally connected to the base (10) and a vertical section extending from the horizontal section;

a tread (30) supported on the base (10);

a U-shaped element (40) including a middle section connected to the supporting unit (20) and two lateral sections extending from the middle section; and two handle units (50) each including:

a bar (54) connected to a related one of the lateral sections of the U-shaped element (40);

a primary handle (53) including front and rear sections both extending from the bar (54) with an obtuse angle defined between them; and an auxiliary handle (52) transversely connected to the bar (54) in front if the primary handle (53).

2. The vertical twist figure shaping machine according to claim 1, wherein the bar (54) includes a screw hole (51) defined therein, wherein the auxiliary handle (52) is threaded and driven in the screw hole (51) of the bar (54).

3. The vertical twist figure shaping machine according to claim 1, wherein the base (10) includes an axle (11) extending vertically from an upper face thereof, wherein the axle (11) is inserted through an aperture defined in the horizontal section of the L-shaped external tube (21) and an aperture defined in the tread (30).

4. The vertical twist figure shaping machine according to claim 3, wherein the axle (11) includes a thread (111) engaged with a nut (31).

5. The vertical twist figure shaping machine according to claim 1, wherein the supporting unit (20) includes an internal tube (22) telescopically inserted in the vertical section of the L-shaped external tube (21).

6. The vertical twist figure shaping machine according to claim 5, wherein the vertical section of the L-shaped external tube (21) includes a screw hole (211) defined therein, wherein the internal tube (22) includes a series of apertures (221) defined therein, wherein the supporting unit (20) includes a screw (213) driven in a selected one of the apertures (221) through the screw hole (211).

7. The vertical twist figure shaping machine according to claim 6, wherein the supporting unit (20) includes a knob (212) attached to an end of a screw (213).

8. The vertical twist figure shaping machine according to claim 5, wherein the middle section of the U-shaped element (40) is pivotally connected to the internal tube (22).

* * * * *